US005291185A

United States Patent [19]

Yoshimura

[11] Patent Number: 5,291,185

[45] Date of Patent: Mar. 1, 1994

[54] IMAGE DISPLAY DEVICE

[75] Inventor: Masahiro Yoshimura, Nara, Japan

[73] Assignee: Sharp Kabushiki Kaisha, Osaka, Japan

[21] Appl. No.: 745,954

[22] Filed: Aug. 9, 1991

Related U.S. Application Data

[63] Continuation of Ser. No. 547,377, Jul. 3, 1990, abandoned, which is a continuation of Ser. No. 307,181, Feb. 2, 1989, abandoned, which is a continuation of Ser. No. 119,308, Nov. 6, 1987, abandoned, which is a continuation of Ser. No. 756,030, Jul. 17, 1985, abandoned.

[30] Foreign Application Priority Data

Jul. 30, 1984 [JP] Japan ..... 59-162460

[51] Int. Cl.[5] ..... G09G 5/18

[52] U.S. Cl. ..... 345/116; 345/213; 348/500

[58] Field of Search ..... 340/730, 789, 791, 803, 340/721, 814, 745, 747, 748, 750, 723, 811, 812, 734; 358/149, 22, 36, 37, 141, 142, 148, 150, 183; 178/70 R; 307/353, 352; H04N 5/04, 5/12

[56] References Cited

U.S. PATENT DOCUMENTS

| | | | |
|---|---|---|---|
| 2,890,280 | 6/1959 | Feyzeau | 358/149 |
| 3,475,556 | 10/1969 | Sasaki et al. | 178/70 R |
| 3,895,374 | 7/1975 | Williams | 340/730 X |
| 3,918,039 | 11/1975 | Clark | 340/730 |
| 3,974,494 | 8/1976 | Yamazaki et al. | 340/789 |
| 3,984,828 | 10/1976 | Beyers, Jr. | 340/730 |
| 4,408,198 | 10/1983 | Kudirka | 340/730 |
| 4,480,442 | 5/1984 | Tanaka | 340/745 |
| 4,491,832 | 2/1982 | Tanaka | 340/721 |
| 4,504,826 | 3/1985 | Leininger | 340/745 |
| 4,604,614 | 8/1986 | Farr et al. | 340/814 |
| 4,626,837 | 12/1986 | Priestly | 358/149 |
| 4,684,936 | 8/1987 | Brown et al. | 340/721 |

OTHER PUBLICATIONS

Trewin; *Synch for Display Address Decoding Station;* IBM Tech Discl Bull, vol. 19, No. 11; Apr. 1977, pp. 4282–4283.

*Primary Examiner*—Richard Hjerpe
*Attorney, Agent, or Firm*—Morrison & Foerster

[57] ABSTRACT

An image display device having unit image elements each arranged in a matrix formation and adapted to display a character signal synthesized with or superposed on an image signal further comprises means for matching the dot timing of the character signal and the scanning timing determined by the number of image elements of the image display device so that characters can be clearly displayed against a background image.

8 Claims, 4 Drawing Sheets

IMAGE DISPLAY DEVICE

This is a continuation of application Ser. No. 547,377 filed on Jul. 3, 1990, now abandoned, which is a continuation of application Ser. No. 307,181 filed Feb. 2, 1989 and now abandoned, which is a continuation of application Ser. No. 119,308 filed Nov. 6, 1987 and now abandoned, which is a continuation of application Ser. No. 756,030 filed Jul. 17, 1985 and now abandoned.

This invention relates to an image display device with unit image elements arranged in a matrix formation and more particularly to an image display device of a dot matrix type which, when an image signal and a character signal are synthesized or superposed together to be inputted, is capable of displaying inserted characters clearly without the blurring or deformation on the screen caused by the displacement between the signals.

There are currently available and also being developed many types of image monitoring systems such as view finders of video cameras which are adapted to display characters simultaneously with an image in order to provide to the user various information such as a focusing error and an underexposure. Such systems are generally adapted to synthesize or superpose a character signal at an optional position on an image signal and when a display is made by a monochromatic cathode ray tube (CRT), characters can be displayed with the brightness determined by the transmission characteristics of the character signal generator as well as the transmission system for this signal and the characteristics of the display system itself.

When the aforementioned character signal is displayed by an image display device of a dot matrix type, however, the character image becomes blurred and the characters become distorted if the pitch of the image elements for the image display device and that of the dots for the character signal do not match. Explained more in detail, the display density, or the shading gradation of each image element (determined by brightness in the case of a light emitting device and by reflectivity, transmissivity, etc. in the case of a non-light emitting device) depends on the average value during the period in which this image element is selected if the display device does not include signal storage capacitors, etc. for storing image element driving signals for the individual image elements. If the pitch of image elements and the signal pitch coincide as shown in the interval "a" of FIG. 4, shading gradation of the character sections takes a desired value and hence there is no problem. If the pitch of image elements do not match the signal pitch with a displacement of $\theta$ therebetween, however, shading of the corresponding image element is shifted from the specified level by an amount which is determined by the background signal value and $\theta$. This causes blurring and distortion of characters and the quality of display is adversely affected.

The interval "b" of FIG. 4 shows a situation when white characters are displayed against a black background on a screen. In this situation, the image is displayed at the image display device in such a way that the signal level of the corresponding image elements is shifted from the white level W to the black level B by a value $x=(\theta/\tau_0)x_0$ which is proportional to the phase shift $\theta$.

If the image display device is provided with signal storage capacitors or the like for storing image elements driving signals for the individual elements, the shading gradation for the display of each image element is determined by the level of the signal of the signal storage capacitor, etc. at the point in time after the signal storage capacitor corresponding to this image element is charged or discharged during a period in which this image element is selected and when the selection of this image element is completed. Accordingly, there is no problem and display can be obtained with the desired shading if the time constant of the signal storage capacitor, etc. is small so that the signal voltage of the element can sufficiently quickly follow the image signal given from outside and the signal level of the element is charged or discharged to the same level as the image signal given from outside while this image element is being selected. If the time constant of the signal storage capacitor, etc. is large so that it takes a long time to charge or discharge until signal voltage of the element reaches the same level as that of the image signal voltage given from outside, however, display is not made on the desired level. An example of this situation is illustrated in FIG. 5.

With reference to FIG. 5 wherein the time constant for charging and discharging of the signal storage capacitor is $\tau$, if the phase difference $\theta$ between the image element pitch and the character signal is small and there is plenty of time to charge or discharge the signal storage capacitor, etc., or $\tau_0-\theta>\tau$ as in the interval "c" of FIG. 5, the displayed image is on the desired level and there is no difficulty. If, on the other hand, the phase difference $\theta$ between the image element pitch and the character signal is large and the signal level of the signal storage capacitor, etc. is not sufficiently charged or discharged, display is made as shown in the interval as an image which is shifted from the intended level (the white level W in FIG. 5) to the black level B by $x=x_0exp[-(\tau_0-\theta)/\tau]$.

It is therefore an object of this invention to provide an image display device capable of preventing unclear display of characters caused by a phase shift between the character signal which is superposed on or synthesized with an image signal and the image elements.

The above object is achieved by providing an image display device having unit image elements each in a matrix formation and adapted to display character signals synthesized with or superposed on an image signal, the device further comprising a means for matching the dot timing of the character signal and the scanning timing determined by the number of its image elements.

Other objects and aspects of the present invention will become apparent from the detailed description of an embodiment of the present invention given below. It should be understood, however, that the description of the specific embodiment given below is given by way of illustration only and not intended to limit the scope of this invention.

The present invention will be better understood from the detailed description given below and the accompanying drawings which are given by way of illustration only, and thus are not limitative of the present invention.

An image display device of the present invention is characterized in that the phase of the character signal provided to it is forcibly made to match the pitch of its image elements and that a sample-and-hold circuit is inserted between a character signal or synthesized signal generator and a display device as will be shown by way of an example below so that a character signal or a synthesized signal will be preserved during the display period of the unit image element.

Figure 1:
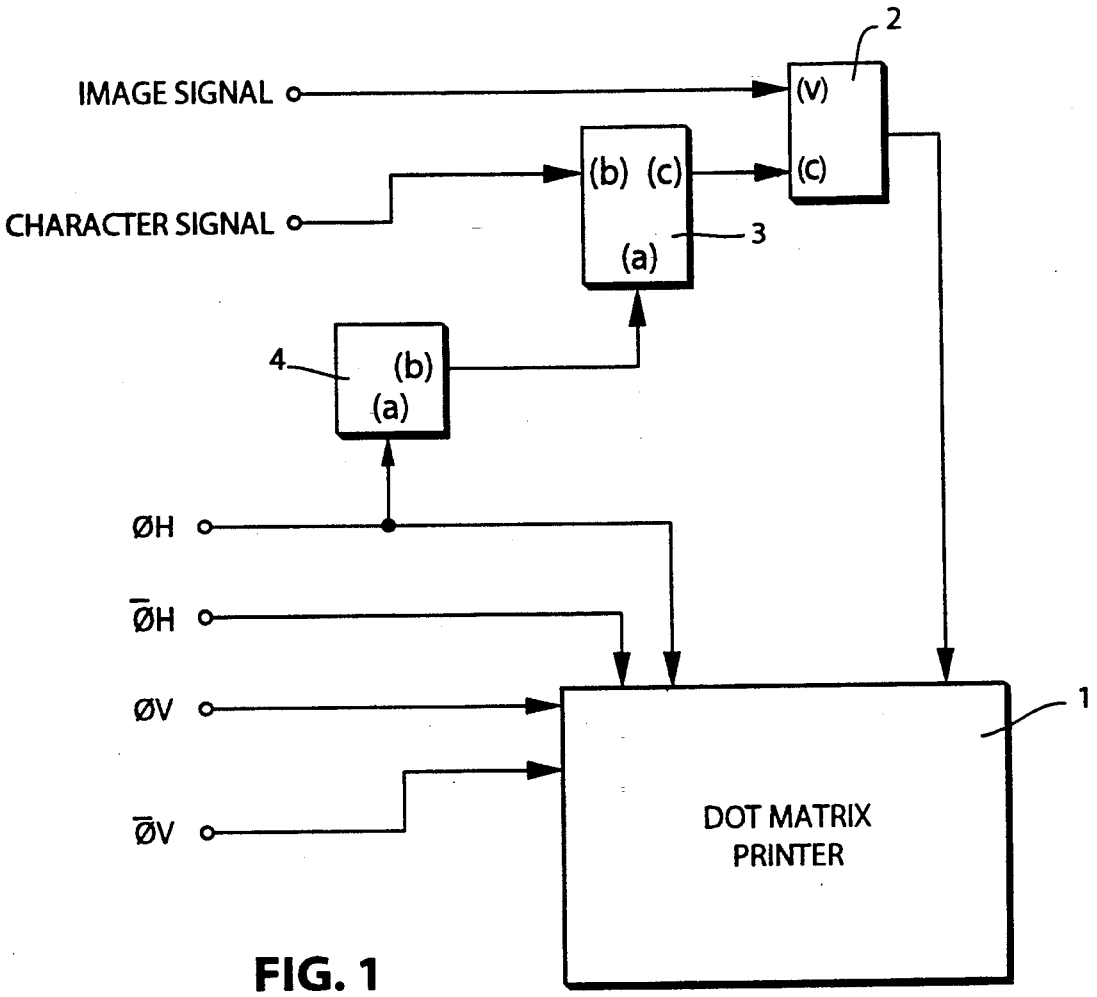
FIG. 1 is a block diagram of an image display device according to one embodiment of the present invention.

Reference being made to FIG. 1 which is a block diagram for showing the structure of one embodiment of the present invention, numeral 1 indicates a display device of a dot matrix type adapted to selectively display one image element during a period from one rise of a pulse signal $\phi_H$ to the next rise. Numeral 2 indicates an image synthesizer adapted to synthesize or superpose inputted image and character signals and to supply the result to the display device. Numeral 3 indicates a sample-and-hold circuit which is disposed between a character signal input terminal and the image synthesizer 2 and is adapted to save the image signal for the rising part of the signal $\phi_H$ for one period of $\phi_H$, that is, for the period of scanning one image element by means of a sample-and-hold signal (to be described below). Numeral 4 indicates a sample-and-hold signal generating circuit adapted to input the signal $\phi_H$ and to generate and supply to the sample-and-hold circuit 3 a sample-and-hold signal showing the rising part of the signal $\phi_H$. The signals $\phi_V$ and $\phi_V$ supplied to the display device 1 are pulse signals for scanning the display device 1 in perpendicular directions.

Figure 2A:
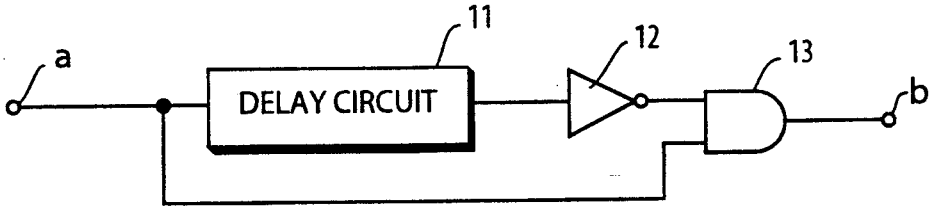
FIG. 2(*a*) is an example of a block diagram of a sample-and-hold signal generating circuit and FIG. 2(*b*) is an example of a block diagram of a sample-and-hold circuit.
Figure 2B:
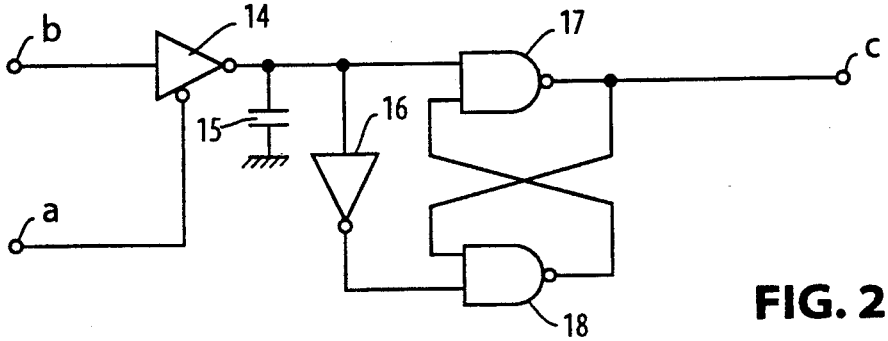

FIG. 2(*a*) is a block diagram showing an example of the sample-and-hold signal generating circuit 4. It comprises a delay circuit 11, an inverter 12 and an AND gate 13. A sample-and-hold signal is outputted from the terminal b when the signal $\phi_H$ is inputted at the terminal a. FIG. 2(*b*) is a block diagram showing the sample-and-hold circuit 3 of FIG. 1 according to one embodiment. It comprises inverters 14 and 16, a capacitor 15 and AND gates 17 and 18. If a sample-and-hold signal is inputted from the terminal a and an input character signal is inputted from the terminal b, a sample-and-hold output of the character signal is obtained from the terminal c.

Figure 3:
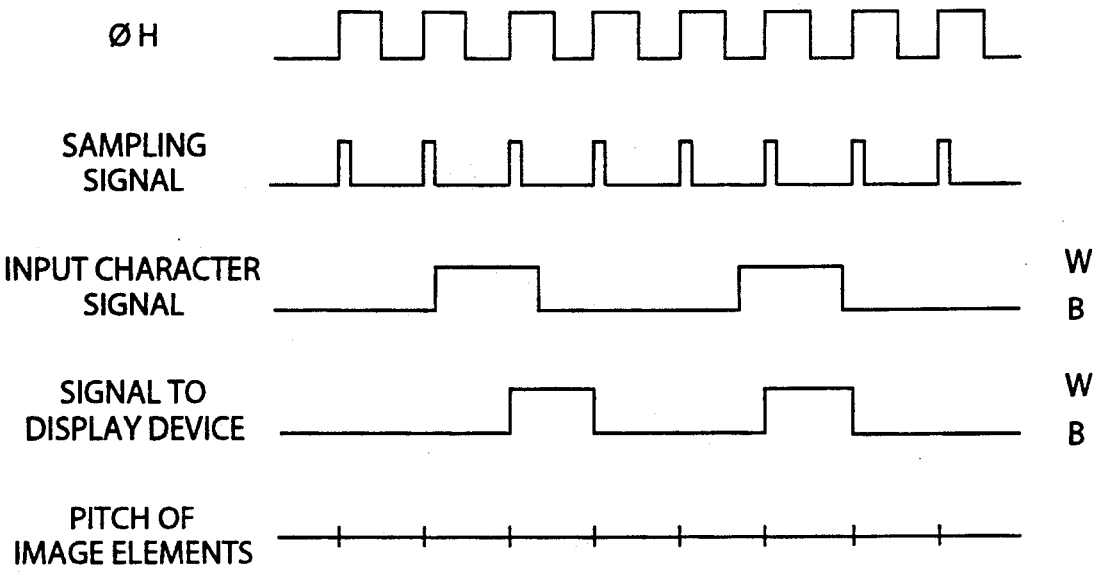
FIG. 3 is a signal waveform diagram for showing the operation of the image display device of FIG. 1.
Figure 4:
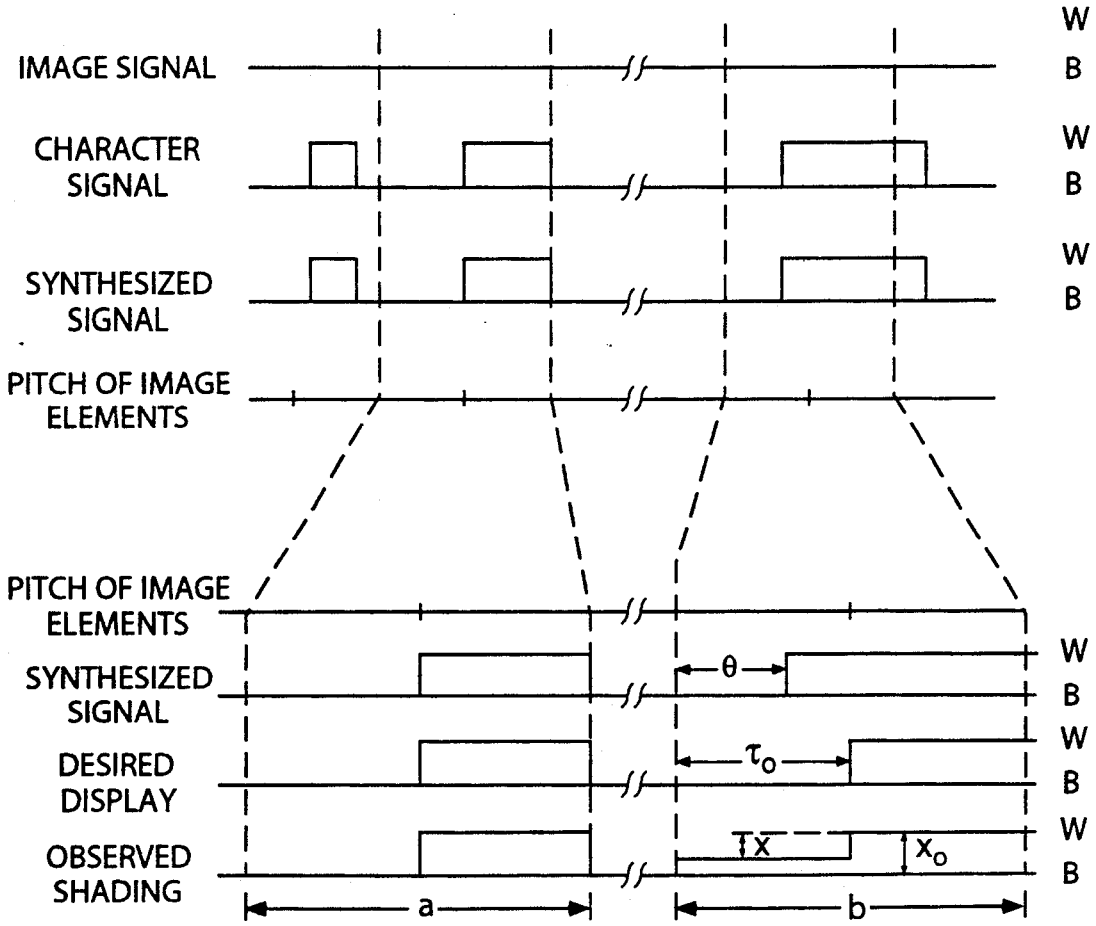
FIG. 4 is a diagram for showing the display operation of a conventional display device which does not include an image signal storage element.
Figure 5:
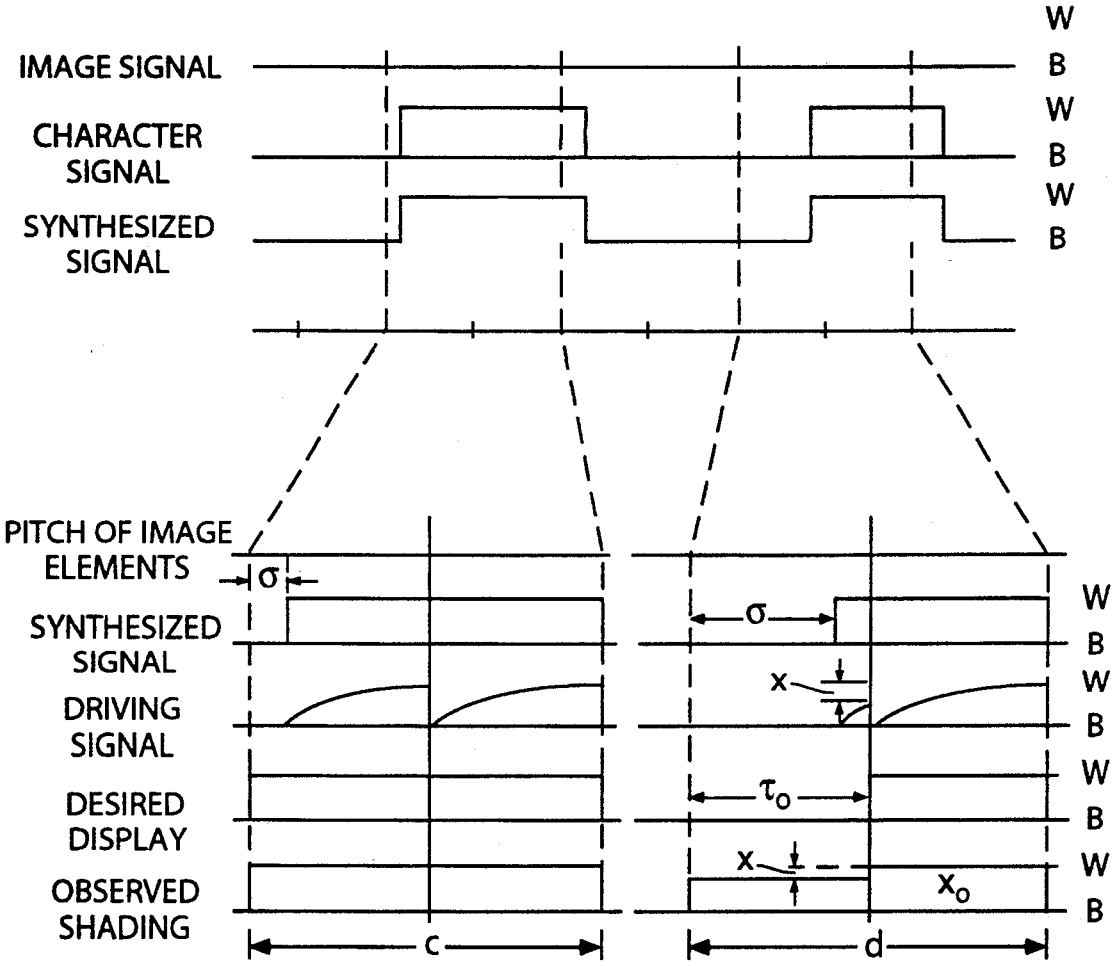
FIG. 5 is a diagram for showing the display operation of a conventional display device which does include an image signal storage element.

FIG. 3 is a signal waveform diagram for explaining the display by the device of FIG. 1. The operation of the device of FIG. 1 will be explained next by means of the diagram of FIG. 3.

When the signal $\phi_H$ is inputted, the sample-and-hold signal generating circuit 4 generates a sample-and-hold signal and supplies it to the terminal a of the sample-and-hold circuit 3. When a sample-and-hold signal is inputted, the sample-and-hold circuit 3 keeps the image signal of the rising part of the pulse signal $\phi_H$ inputted to the terminal b by the sample-and-hold signal for one period of the signal $\phi_H$, or for the scanning period of one image element, generates a character signal in synchronism with the image element pitch, outputs it from the terminal c and supplies it to the image synthesizer 2. As a result, a character signal in synchronism with the image element pitch is supplied to the display device 1 so that a clear display of characters without blurring and distortions can be obtained.

Figure 6:
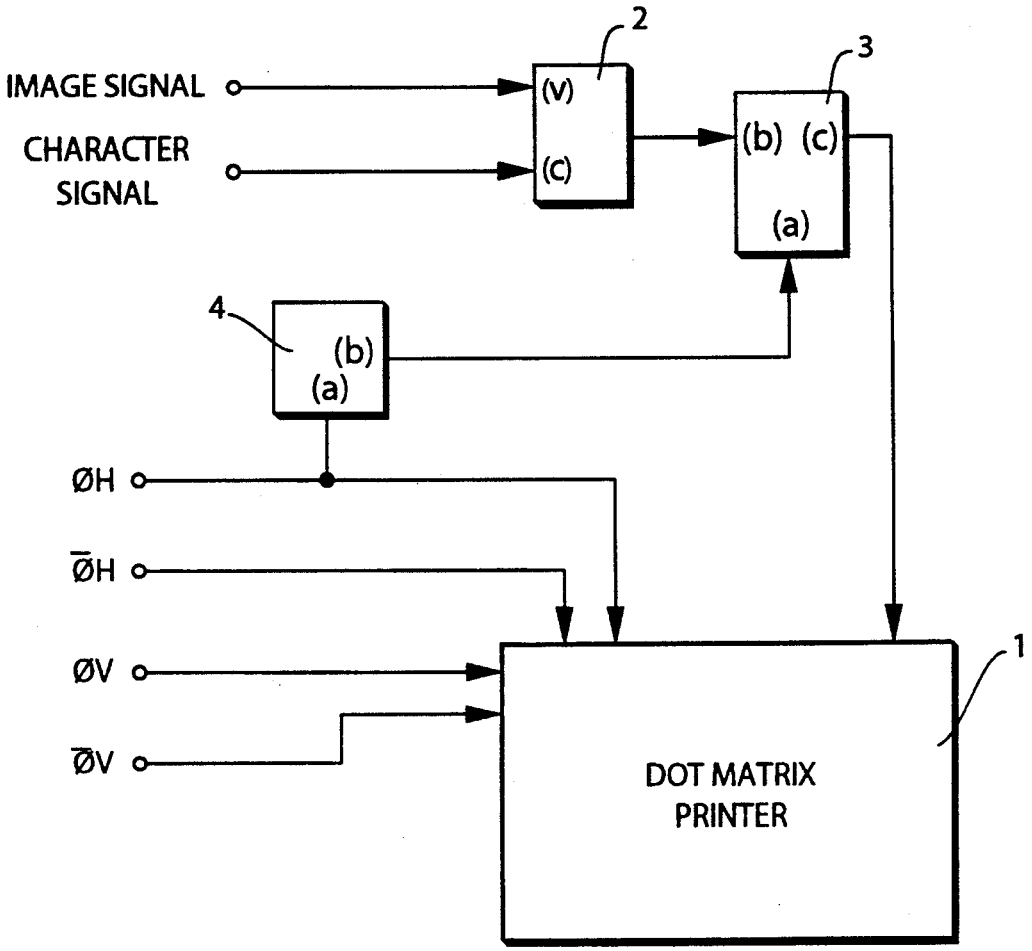
FIG. 6 is a block diagram of an image display device according to another embodiment of the present invention.

In other words, when an image signal and a character signal for representing characters are synthesized or superposed together and given to a display device of a dot matrix type, the present invention makes it possible to display characters clearly by eliminating blurring and distortions of characters on the screen caused by displacements between the signals because there is provided between the character signal and the display device a sample-and-hold circuit for matching the dot timing of the character signal and the scanning timing determined by the number of image elements of the display device. Although the embodiment described above showed the sample-and-hold circuit between the character signal and the display device, this invention is not intended to be limited by it. It goes without saying that the sample-and-hold circuit may be disposed equally well between the synthesized signal generator and the display device as is shown in FIG. 6.

In summary, the present invention provides an image display device with unit image elements arranged in a matrix formation which, with a simple additional circuit, can display characters clearly without blurring or distortions when a character signal synthesized with or superposed on an image signal is received.

Although the present invention has been described above in terms of only one particular embodiment, it will be obvious that the same may be varied in many ways. Various changes and modifications within the spirit of the invention will become apparent to those skilled in the art and such changes and modifications are not to be regarded as a departure from the scope of this invention but to be included within the scope of the following claims.

What is claimed is:

1. An image display device including a dot matrix display device having a plurality of unit image elements arranged in a matrix formation adapted to receive an image signal, a character signal and a pulse signal and to selectively display one of said unit image elements between successive leading edges of said pulse signal in response to receiving said image signal and said character signal, comprising:

signal generating means receiving said pulse signal and generating a sample-and-hold signal indicative of a leading edge of said pulse signal;

sample-and-hold means for sampling and holding said character signal in response to said sample-and-hold signal and outputting a sampled character signal; and signal synthesizing means generating a display signal on the basis of said image signal and said sampled character signal and transmitting said display signal to said dot matrix display device.

2. An image display device according to claim 1 wherein said signal generating means comprises:

a delay circuit receiving said pulse signal and generating a delayed signal by delaying said pulse signal;

an inverter for receiving said delayed signal and for generating an inverted signal by inverting said delayed signal; and an AND gate receiving said inverted signal and said pulse signal and generating said sample-and-hold signal by executing an AND operation on said inverted signal and said pulse signal.

3. An image display device according to claim 1 wherein said signal synthesizing means generates said display signal by synthesizing said image signal and said sampled character signal.

4. An image display device according to claim 1 wherein said signal synthesizing means generates said display signal by superposing said image signal and said sampled character signal.

5. An image display device including a dot matrix display device having a plurality of unit image elements arranged in a matrix formation adapted to receive an image signal, a character signal and a pulse signal and to selectively display one of said unit image elements between successive leading edges of said pulse signal in response to receiving said image signal and said character signal, comprising:

signal generating means receiving said pulse signal and generating a sample-and-hold signal indicative of a leading edge of said pulse signal;

signal synthesizing means for generating a display signal on the basis of said image signal and said character signal; and a sample-and-hold means for sampling and holding said display signal in response to said sample-and-hold signal and for transmitting the sampled display signal to said dot matrix display device.

6. An image display device according to claim 5, wherein said signal generating means comprises:

a delay circuit for receiving said pulse signal and for generating a delayed signal by delaying said pulse signal;

an inverter receiving said delayed signal and generating an inverted signal by inverting said delayed signal; and an AND gate receiving said inverted signal and said pulse signal and generating said sample-and-hold signal by executing an AND operation of said inverted signal and said pulse signal.

7. An image display device according to claim 5 wherein said signal synthesizing means generates said display signal by synthesizing said image signal and said character signal.

8. An image display device according to claim 5 wherein said signal synthesizing means generates said display signal by superposing said image signal and said character signal.

* * * * *

UNITED STATES PATENT AND TRADEMARK OFFICE

CERTIFICATE OF CORRECTION

PATENT NO. : 5,291,185

DATED : March 1, 1994

INVENTOR(S) : Masahiro Yoshimura

It is certified that error appears in the above-indentified patent and that said Letters Patent is hereby corrected as shown below:

On drawing sheets showing Figs. 1 and 6, in item referenced "1": "PRINTER" should read —DISPLAY—

Signed and Sealed this

Eighteenth Day of July, 1995

*Attest:*

Bruce Lehman

BRUCE LEHMAN

*Attesting Officer*

*Commissioner of Patents and Trademarks*